US006056681A

United States Patent [19]

Ross

[11] Patent Number: 6,056,681

[45] Date of Patent: May 2, 2000

[54] APPARATUS FOR FORMING FLAT-BOTTOMED PLASTIC BAGS

[76] Inventor: Philip E. Ross, 38780 Dodds Landing, Willoughby Hills, Ohio 44094

[21] Appl. No.: 08/989,490

[22] Filed: Dec. 12, 1997

Related U.S. Application Data

[60] Provisional application No. 60/032,719, Dec. 13, 1996.

[51] Int. Cl.[7] ..... B31B 1/90

[52] U.S. Cl. ..... 493/218; 493/228; 493/936; 493/197; 493/24

[58] Field of Search ..... 493/3, 13, 24, 493/193, 194, 197, 199, 218, 243, 251, 258, 259, 936, 228, 288; 83/16

[56] References Cited

U.S. PATENT DOCUMENTS

| | | | |
|---|---|---|---|
| 2,256,506 | 9/1941 | Wagner | 493/197 |
| 3,023,679 | 3/1962 | Piazze | 493/203 |
| 3,172,342 | 3/1965 | Potdevin | 493/243 |
| 3,988,970 | 11/1976 | Hanson et al. | 493/256 |
| 4,100,396 | 7/1978 | Martin | 83/16 |
| 4,268,346 | 5/1981 | Achelpohl | 493/194 |
| 4,692,135 | 9/1987 | Johnson | 493/193 |
| 4,866,786 | 9/1989 | Nagler | 493/244 |
| 4,929,224 | 5/1990 | Hanson et al. | 493/194 |
| 5,102,384 | 4/1992 | Ross et al. | 493/256 |
| 5,149,315 | 9/1992 | Muhs | 493/253 |
| 5,853,360 | 12/1998 | Jeffrey et al. | 493/243 |

*Primary Examiner*—Eugene L. Kim
*Attorney, Agent, or Firm*—Plunkett & Cooney, P.C.

[57] ABSTRACT

A method and apparatus for forming flat-bottomed plastic bags uses a flattened plastic tubing as a raw material. The tubing is unwound from a roll, and is passed around a gusset plate assembly, where guide members on opposite sides of the gusset plate assembly guide outside edges of the tubing inwardly between a pair of gusset plates to form gussets in the tubing. In a preferred embodiment, microperforations are formed in the bag material to provide ventilation to the finished bags.

12 Claims, 9 Drawing Sheets

FIG 1
PRIOR
ART
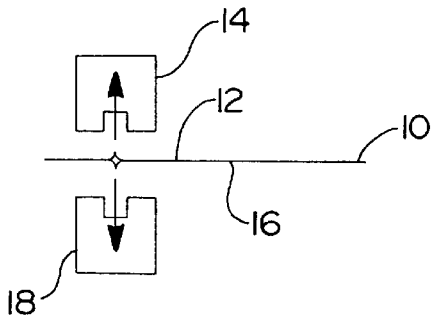
FIG 1A
PRIOR
ART
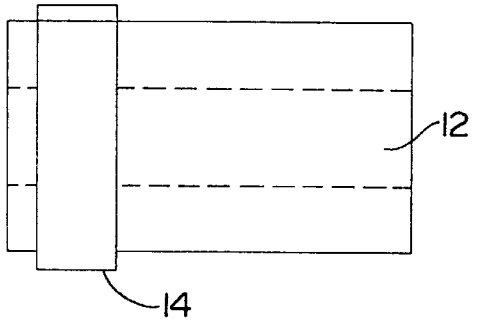
FIG 1B
PRIOR
ART
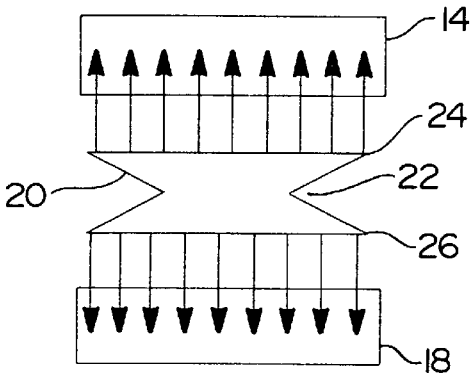
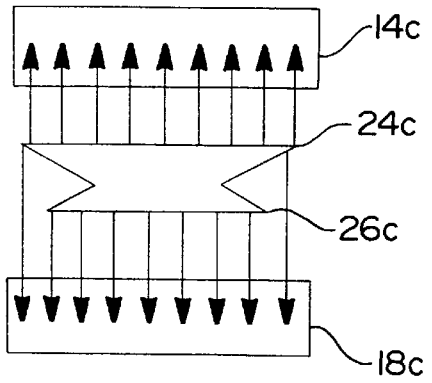
FIG 1C
PRIOR
ART FIG 3A
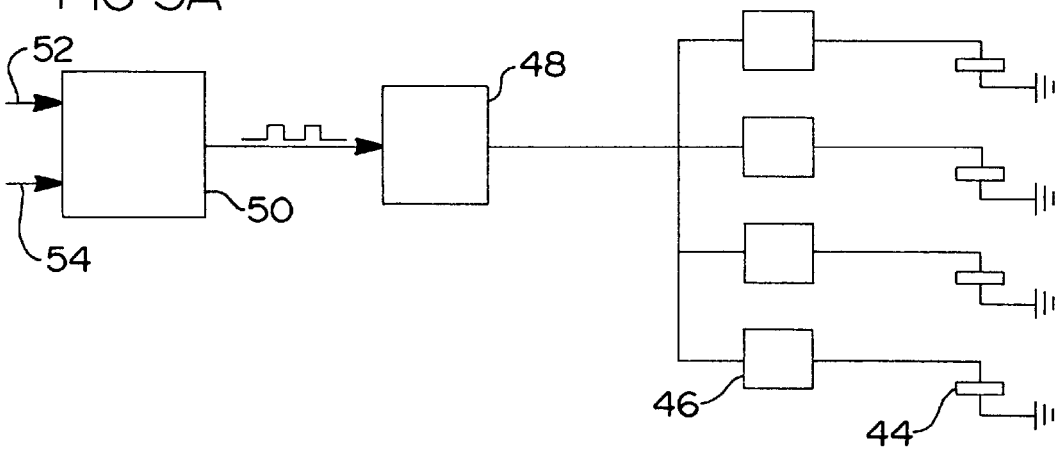
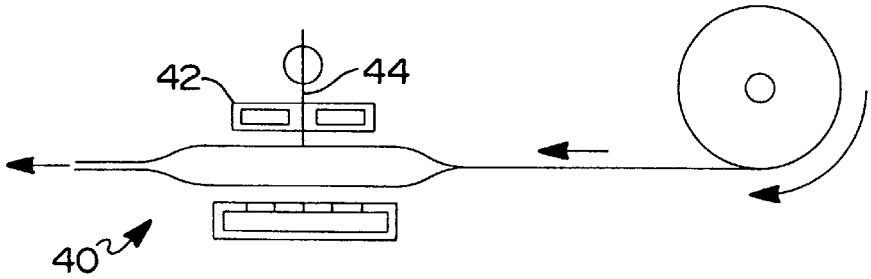
FIG 3B FIG 4
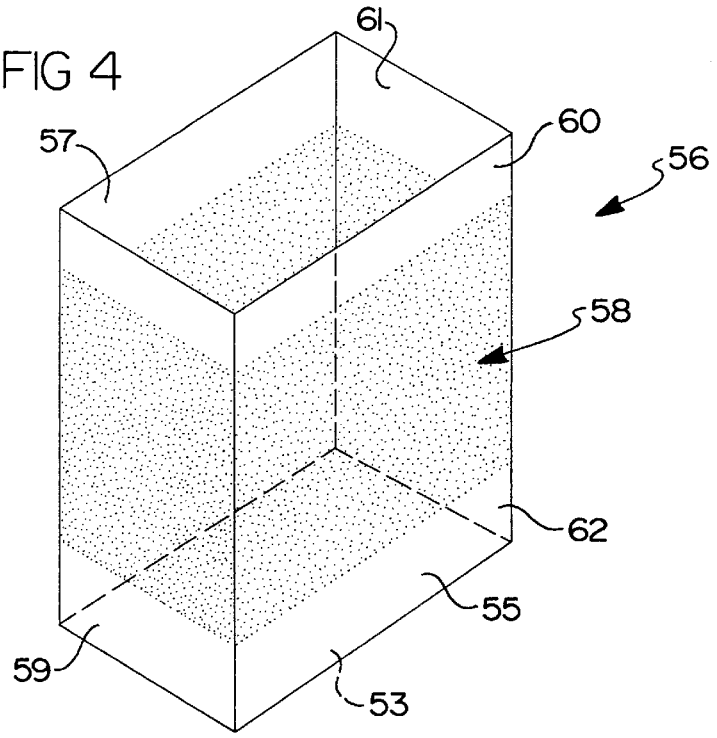
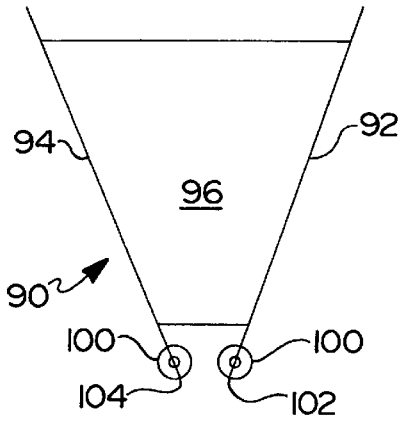
FIG 6D
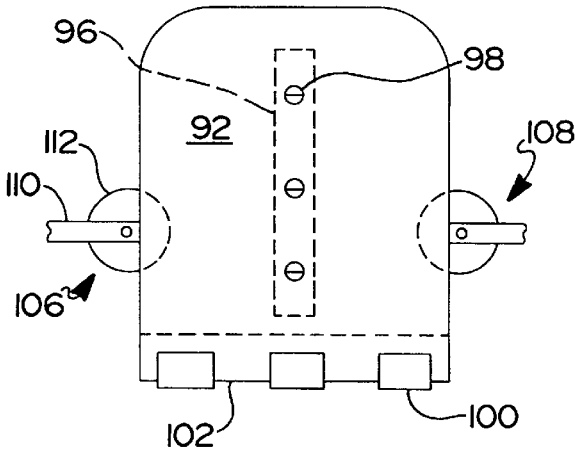
FIG 6E FIG 5A
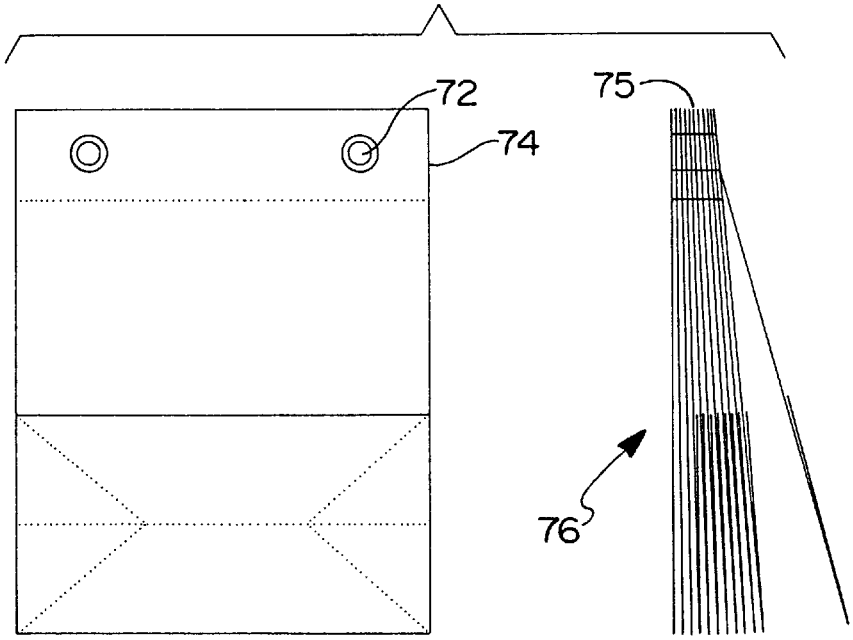
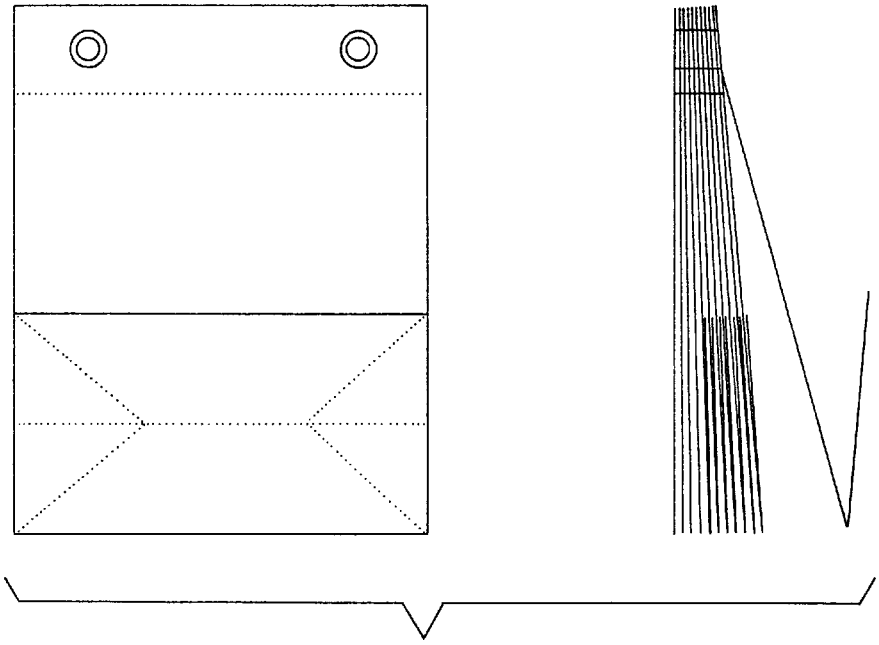
FIG 5B FIG 6A
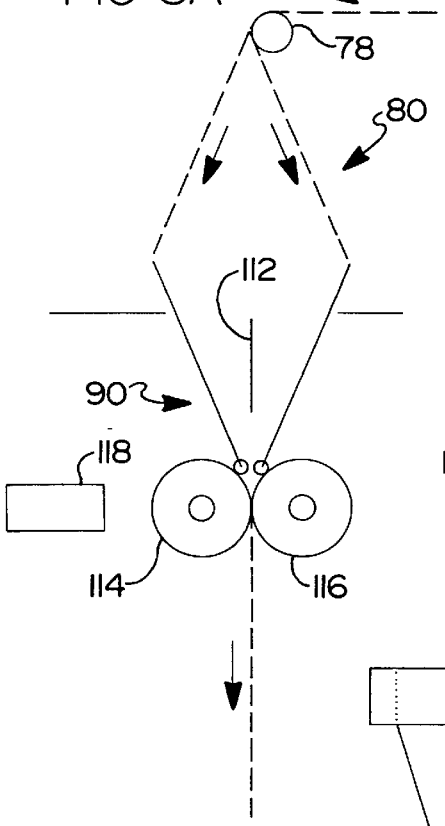
FIG 6C
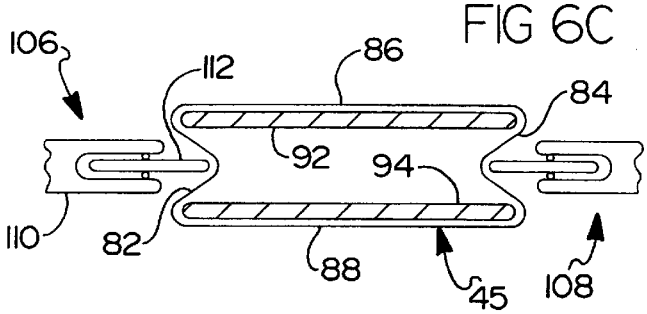
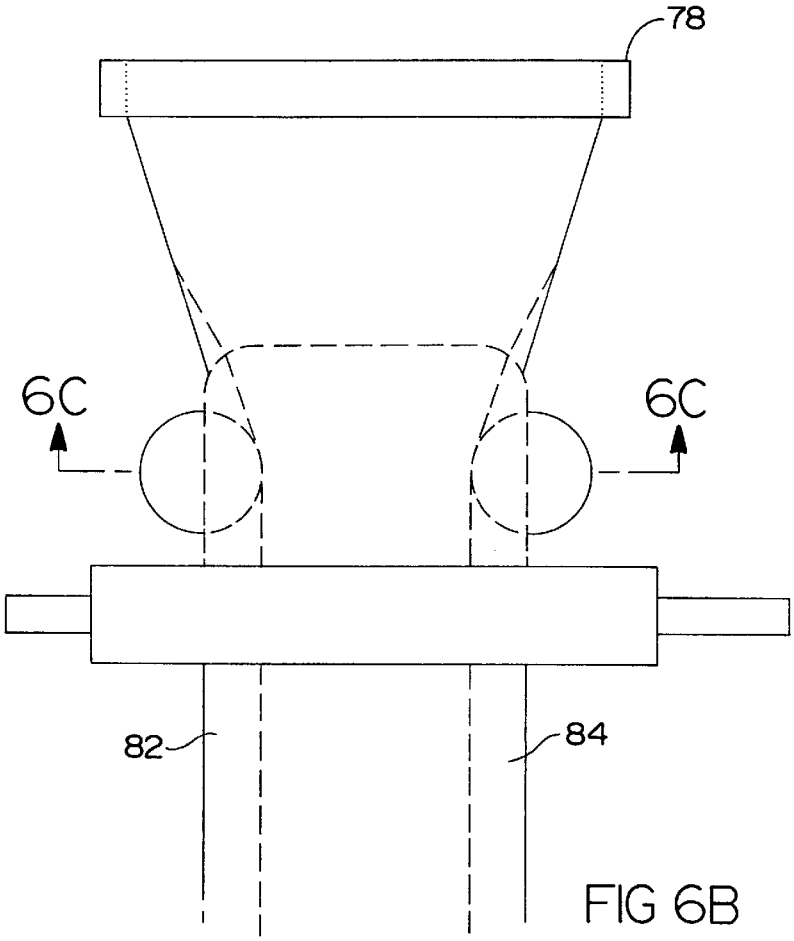
FIG 6B

APPARATUS FOR FORMING FLAT-BOTTOMED PLASTIC BAGS

CROSS-REFERENCE TO RELATED APPLICATIONS

The present application claims a priority date of Dec. 13, 1996, under 35 U.S.C. 119(e) from Provisional application Ser. No. 60/032,719.

BACKGROUND OF THE INVENTION

1. Field of the invention

The present invention relates to an apparatus for forming flat-bottomed plastic bags, and to a method of forming such bags. More particularly, the present invention relates to a method of, and an apparatus for forming flat-bottomed plastic bags having precision formed gussets in the sides thereof, which gussets are formed subsequent to the initial manufacture of the hollow tubing which is the starting material for the bags. In a preferred embodiment, microperforations are formed in a portion of the bags to allow ventilation thereof The present invention further relates to a finished bag, which is produced using the method and apparatus of the invention.

2. Description of the Background Art

Some types of foldable flat-bottomed plastic bags are available on the market today, and different methods are used for their manufacture. One type of plastic bag forming machine and method of operation is disclosed in U.S. Pat. No. 4,929,224 to Hanson et al., which uses closed sleeve plastic material with inwardly gusseted sides as a raw starting material. Another method of making flat-bottomed plastic bags is disclosed in U.S. Pat. No. 5,102,384 to Ross et al., the disclosure of which is incorporated by reference herein, insofar as it is not inconsistent with the present disclosure.

FIGS. 1 through 1C of the drawings, provided herewith, illustrate a part of the known method of forming flat-bottomed plastic bags from a roll of pre-gusseted or pleated tubing. In the method of Ross et al, a portion of a pre-gusseted plastic film tube is unrolled from a roll of such tubing stock, and the tube is cut and sealed at a bottom section thereof to define a bag 10. Then, an upper surface 12 of the bag 10 is grasped by a movable upper vacuum clamp 14, a lower surface 16 of the bag 10 is grasped by a fixed lower vacuum clamp 18, and the upper and lower surfaces are moved apart. Subsequently, the movable upper clamp moves toward the top of the bag while holding a transverse section thereof, to fold a rectangular shape into the bottom of the bag, and creases are made in the corner edges of the bag 10 to form a flat bottom therein.

Unfortunately, it has been found that the commercially available pre-gusseted tubing is not made with the pleats or gussets formed at a consistent depth from the outside edge of the tubing, but rather, contains gussets in which the depth varies to an excessive and unacceptable degree. Moreover, other variations may exist in the pre-gusseted tubing which can also lead to problems.

Referring now to FIG. 1B, it may be seen that in properly shaped pre-gusseted tubing, evenly-shaped gussets 20, 22 are formed in the sides of a portion of tubing so that upper and lower gusset legs 24, 26, respectively, are of the same length. Accordingly, when vacuum, symbolized by the arrows in FIG. 1B, is applied to the upper and lower clamps 14, 18, transversely along the upper surface of the tube, the upper surface 12 is picked up by the upper clamp 14, and the lower surface 16 is held by the lower clamp 18.

In contrast, however, when the pre-gusseted tubing is not made properly, as shown in FIG. 1C, it may have gusset legs 24*c*, 26*c*, of different lengths, so that one leg 24*c* may extend beyond another 26*c*. As a result, when vacuum is applied to the upper and lower clamps 14*c*, 18*c* in this instance, point B on the upper leg 24*c* has vacuum applied from both above and below. Therefore, the material at point B may not be pulled into the proper clamp. It is unpredictable which direction the material at point B will go, and therefore, a proper bag may not be formed.

Therefore, a need exists in the art for a more consistent and precise method and apparatus for forming flat-bottomed plastic bags.

In addition, some problems exist when attempting to pack hot food such as, e.g., hamburgers, into a plastic bag, because condensation caused by steam from the food tends to form inside the bag, which may be detrimental to the food in the bag. A plastic bag with an ability to 'breathe' might be helpful to solve this problem.

Accordingly, it is an object of the present invention to provide a method and apparatus for forming flat-bottomed plastic bags which gives more consistent and precise results than are obtainable using pre-gusseted tubing. It is another object of the present invention to provide a method and apparatus for forming flat-bottomed plastic bags which involves forming gussets in tubing which initially does not have any pleats or gussets previously formed therein.

It is another object of the present invention to provide a method and apparatus for forming flat-bottomed plastic bags that are permeable to moisture, and to provide such moisture-permeable bags as a product thereof Other objects, features and advantages of the present invention will become apparent from a review of the following detailed description section, which should be read in conjunction with the drawings.

SUMMARY OF THE INVENTION

The present invention provides an improved method and apparatus for forming flat-bottomed plastic bags. A method of forming flat-bottomed bags from a web of plastic film tubing according to the present invention, generally, includes the steps of measuring a predetermined length of the tubing to define a bag form having an upper surface and a lower surface and two side edges;

separating the upper and lower surfaces of the bag form;

moving the side edges of the bag form inwardly to form gussets between the upper and lower surfaces;

sealing the bag form at a lower end thereof;

cutting the bag form away from the web to define a bag; and creasing the bag to form a flat bottom therein.

The method according to the present invention may further include a step of perforating the bag to provide ventilation thereof.

As noted, the present invention also includes an apparatus for forming flat-bottomed plastic bags from a web of plastic film tubing. An apparatus according to the present invention, generally, includes:

means for measuring a predetermined length of the tubing to define a bag form having an upper surface and a lower surface and two side edges;

means for separating the upper and lower surfaces of the bag form;

gusseting means for moving the side edges of the bag form inwardly to form gussets between the upper and lower surfaces;

means for sealing the bag form at a lower end thereof;

means for cutting the bag form away from the web to define a bag; and means for creasing the bag to form a flat bottom therein.

Preferably, the separating means includes a gusset plate assembly for placement inside the tubing, the gusset plate assembly including an upper gusset plate, a lower gusset plate, and a reinforcement member which interconnects the upper and lower gusset plates, the gusset plates extending beyond the reinforcement member on two sides thereof In the most preferred embodiment hereof, each of the upper and lower gusset plates has a trailing edge with rollers attached thereto, for facilitating the movement of plastic film tubing therepast.

Furthermore, in the preferred embodiment of the present invention, the gusseting means includes a pair of guide members disposed on opposite sides of the gusset plate assembly for guiding opposite side edges inwardly, each guide member having a bag contacting section which is disposed between the upper and lower gusset plates. Most preferably, each guide member includes a support shaft and a rotatable disc pivotally mounted on the shaft, a portion of the disc being disposed between the upper and lower gusset plates.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 1 is a cross-sectional view of a prior art vacuum and clamp assembly showing a plastic film tubing passing therethrough, the section taken through a plane vertically bisecting the assembly and showing a first time;

FIG. 1A is an end view of the vacuum and clamp assembly and plastic film tubing of FIG. 1;

FIG. 1B is an end view of the prior art vacuum and clamp assembly and plastic film tubing of FIGS. 1–1A, taken at a time subsequent to the time shown in FIG. 1 and through a plane perpendicular to that of FIG. 1, and illustrating a properly formed gusset in the plastic film;

FIG. 1C is an end view which is substantially similar to FIG. 1B, but illustrating a plastic film tubing with an improperly formed gusset therein;

FIG. 3A is an electrical schematic of a pore-forming mechanism which is an optional component of the apparatus of FIG. 2;

FIG. 3B is a side plan view of the pore-forming mechanism diagrammed in FIG. 3A;

FIG. 4 is a perspective view of a porous, flat-bottomed plastic bag which is a product of a preferred embodiment of the method and apparatus of the present invention;

FIG. 5A is a front and side plan view of a stack of bags according to a first type of attachment to a bag header;

FIG. 5B is a front and side plan view of a stack of bags according to a second type of attachment to the bag header;

FIG. 6A is a side plan detail view of a gusset-forming station which makes up a part of the apparatus of FIG. 2;

FIG. 6B is a front plan view of the apparatus of FIG. 6A;

FIG. 6C is a vertical cross-sectional view through the line 6C—6C of FIG. 6B;

FIG. 6D is a side plan view of a gusset plate assembly which is one part of the gusset-forming station of FIG. 6A–6C;

FIG. 6E is a front plan view of the gusset plate assembly of FIG. 6D, also showing a pair of guide members;

DETAILED DESCRIPTION OF THE PREFERRED EMBODIMENT

Figure 2:
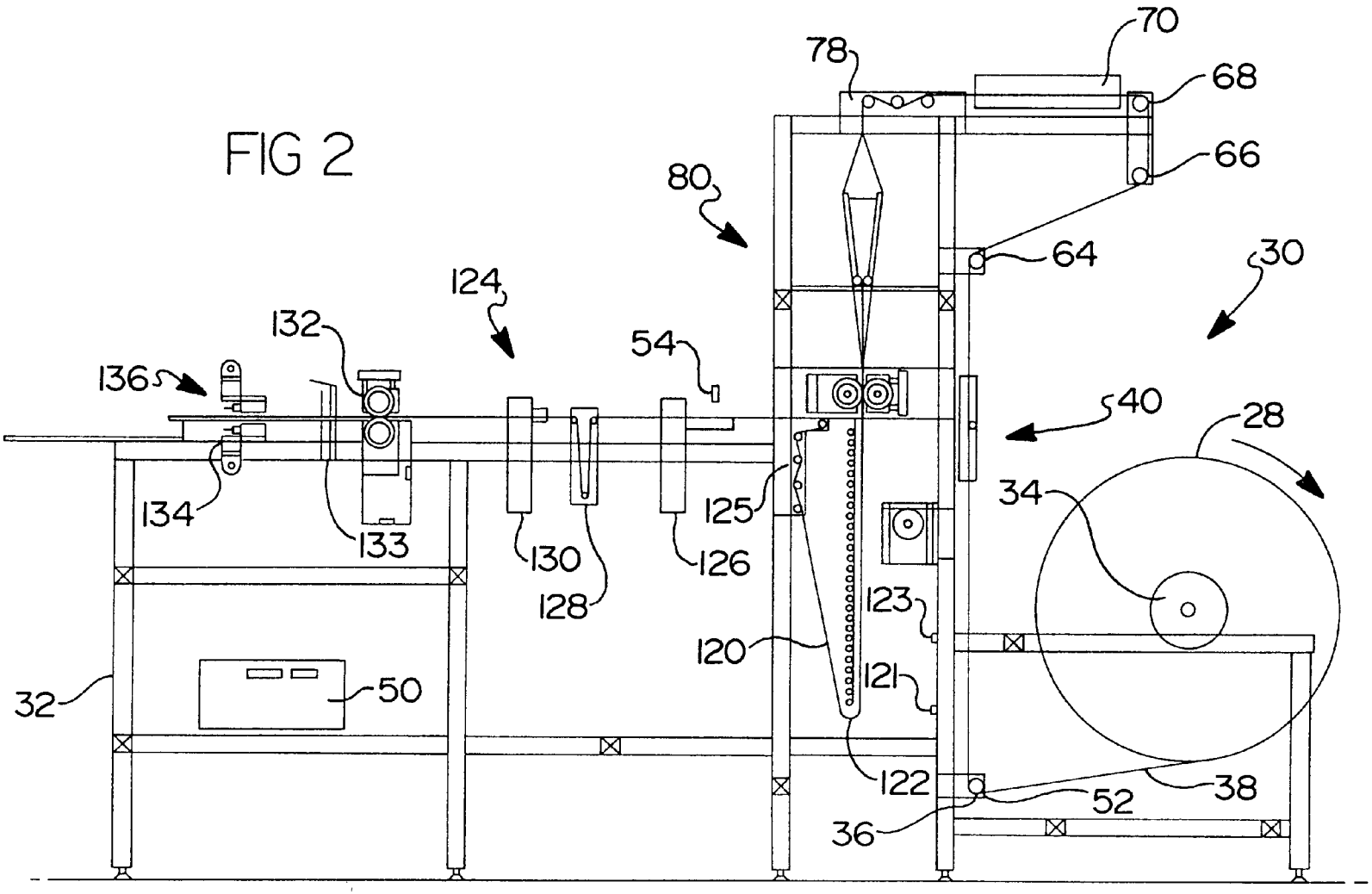
FIG. 2 is a side plan view of a plastic bag forming apparatus in accordance with the present invention.

Referring now to FIG. 2 of the drawings, an apparatus for making flat-bottomed bags from a continuous web of thin-film plastic tubing is shown generally at 30. The apparatus 30 includes a metal support frame 32 for structural strength and support, with various components mounted on the frame to make up process stations, as will be set out in further detail herein.

The apparatus 30 is designed to be used with a roll 28 of flat plastic tubing, that is, tubing which does not have pre-formed pleats or gussets therein. The tubing roll 28 may be, e.g., 30 inches in diameter. The roll 28 of tubing spins on a support roller 34 which is pivotally mounted to the support frame 32. The support roller 34 may have a braking mechanism (not shown) attached thereto.

A first transfer roller 36 is pivotally mounted to the frame 32 below the support roller 34, and the first transfer roller may have a web speed sensor 52 attached thereto. Using information from the web speed sensor 52 and from one or more electric eyes 54, a section of the web 38 is measured off electronically and becomes a bag form 45, that is, a designated section of the web which is later to become a bag. After being unrolled from the roll 28, the tubing web 38 wraps around the first transfer roller 36 and then moves upwardly to an optional electronic perforator 40.

As best seen in FIGS. 3A and 3B, in a preferred embodiment thereof, the electronic perforator 40 includes an upper vacuum plate 42 which is hollow and connected to a vacuum source (not shown). A line of electrodes 44 is embedded in the upper vacuum plate, each electrode being in electrical communication with a corresponding high-voltage coil 46. An electronic controller 50, which may include a microprocessor, receives information on web speed and position from sensors 52, 54 mounted on the support frame 32, and sends a signal to a firing circuit 48 which opens and closes the circuit which supplies voltage to the coils 46. In the most preferred embodiment of the present invention, the electronic perforator 40 is selectively activated to perforate only selected areas of the web 38 so that as shown in FIG. 4, the finished bag 56 will be perforated only in the central section 58 thereof, thus leaving the top section 60 and bottom section 62 substantially continuous and free from perforations for purposes of strength and fluid containment. The reason that the bag 56 is perforated in the central section 58 is to allow air and steam to pass freely therethrough, so as to allow the bag to "breathe", in order to minimize condensation inside the bag from hot foods placed therein.

After leaving the electronic perforator 40, the web 38 passes over a second transfer roller 64 and then wraps around third and fourth transfer rollers 66, 68, respectively, at which point the web 38 is traveling horizontally. A punch station 70 mechanically punches a pair of holes 72 at the top of each bag form, in the header section 74 thereof, which later becomes a header 75 in a stack 76 of bags, as seen in FIG. 5A.

GUSSET FORMING STATION

Following treatment by the punch station 70, the web 38 then passes over an idler roller 78 and makes a right angle turn to move vertically downwardly to a gusseting station 80. The method of forming gussets 82, 84, according to the present invention, is referred to as "post gusseting" to refer to the fact that the gussets are formed in the tubing after its initial manufacture and placement on a roll. It has been discovered, in connection with the present invention, that a higher degree of consistency and precision in the size and shape of the gussets 82, 84 is attainable with a post gusset operation as contrasted with using tubing having the gussets already preformed therein.

As best shown in FIGS. 6A through 6E, the gusseting station 80 provides gusseting means for moving the side edges of the bag form 45 inwardly to form gussets 82, 84, between the upper surface 86 and the lower surface 88 of the bag form 45. The gusseting station 80 includes a gusset plate assembly 90 (FIG. 6D) for placement inside the tubing, the gusset plate assembly including an first gusset plate 92, a second gusset plate 94, and a vertically oriented trapezoidal platelike reinforcement member 96 which interconnects the first and second gusset plates. The gusset plates 92, 94 are attached to the reinforcement member in any appropriate fashion, such as by welding or the use of conventional fasteners such as screws 98 as shown, and each gusset plate 92, 94 extends beyond the reinforcement member 96 on two sides thereof, as shown in FIG. 6E. Preferably, each of the gusset plates 92, 94 further has one or more rollers 100 pivotally attached thereto at the trailing edge 102, 104, thereof, respectively, to guide and protect the tubing web 38 as it moves therepast. The tubing web 38 is fed around the outside of the gusset plate assembly 90 as it enters the gusseting station 80.

The gusseting station 80 also includes a pair of guide members 106, 108 disposed on opposite sides of the gusset plate assembly 90 for guiding the side edges of the bag form 45 inwardly to form gussets 82, 84. The guide members 106, 108 remain outside of the bag form 45, as shown. In the preferred embodiment of the present invention, and as illustrated with respect to a first guide member 106, each guide member includes a support shaft 110 and a rotatable disc 112 which is pivotally mounted on the shaft, a portion of the disc 112 being disposed between the upper and lower gusset plates 92, 94 as shown. The innermost edge of the disc 112 contacts a side edge of the bag form 45 and guides it inwardly to form the gusset 82, shown on the left in FIGS. 6C and 6E. The second guide member 108 has substantially identical structure to that described for the first guide member 106 and works in a similar fashion on the opposite side of the bag form to create the opposite gusset 84, shown on the right in the drawing. Just below the guide members 106, 108 in the gusseting station are a pair of nip rolls or capstan rolls 114, 116 which pinch the web 38 tightly together to crease the gussets 82, 84 into place, and which exert a pulling force to continue to draw fresh tubing off of the roll 28. The nip rolls are driven by a conventional electric motor 118.

POST GUSSET BAG FORMATION

After leaving the gusset forming station 80, the flattened and gusseted web 120 then passes under a dancer curtain 122 and upwardly to a table section 124 of the apparatus 30. The dancer curtain 122 is a bamboo curtain which rolls up as it is pushed upwardly by the web, and which works in conjunction with a low limit electric eye 121, with a high limit electric eye 123 and with the electronic controller 50 to control the speed of the nip rolls 114, 116. The vertical portion of the dancer curtain regulates the speed of the nip roller pair 114, 116 while the weight of the dancer curtain provides tension on the web between the nip rollers 114, 116 and the draw roller section 132. The use of this type of dancer curtain is fairly standardized in the bag forming art.

After leaving the dancer 122, the web 120 moves through a roller series 125 and then turns a corner to move substantially horizontally across the table section 124, as shown. Also, the position of each bag form 45 is monitored by a registration control electric eye 54 which sends signals to the controller 50. A seal bar 126 then forms a seal transversely at the bottom of each bag form 45. In the preferred embodiment of the present invention, the seal bar 126 uses heat to form the seal. It is worth noting that the seal fuses the gussets in place in an inwardly folded configuration. This helps in forming the flat rectangular bottom of the finished bag, as will be further discussed below.

An optional take up assembly 128 may be located after the seal bar 126 to provide a means for adjusting the position of the seal at the proper location in the web. Such a take up assembly may be used at any location on the machine, as required by the optional secondary operations. After passing through the take up assembly, the web may pass an optional glue applicator 130 which puts an uncured adhesive into the gussets of each bag form, near the seal, at a location which will later be formed into a pocket in the finished bag. Where used, a preferred adhesive is one which is curable on exposure to ultraviolet light, and the curing thereof takes place subsequent to formation of the flat bottom of the bag in a folding operation.

A set of motorized draw rollers are housed in a draw roller assembly 132 disposed on the table section 124 of the frame 32 just past the glue applicator 130. The draw roller assembly 132 pulls a bag form 45 therethrough, which is a measured length of tubing material equal to the bag length plus the length of the header section 74. The bag form 45 is then in position for the folding and cutting operations. In the folding operation, a stationary lower clamp 134 transversely grasps the bottom surface 88 of the bag form, preferably by the action of a vacuum applied thereto. Then, a movable upper clamp 136 which is initially situated above the lower clamp 134 transversely grips the top surface 86 of the bag form, and is then driven towards the draw roll assembly 132 to form a flat rectangular bottom for the bag, and to fold the bottom flatly on to the bag. Each of the upper and lower clamps 136, 134 forms a crease in the bag form where contact is made.

The fact that the gussets 82, 84 are permanently sealed into the bag form 45 at the bottom thereof means that when the top surface 86 is gripped and raised by the upper clamp, triangular pockets are naturally formed adjacent the seal as the gussets unfold near the bottom of the bag. These triangular pockets allow the bottom of the bag to take on a rectangular shape as it is folded back on the bag surface, in the conventional manner.

CLAMPING ASSEMBLY

Figure 8A:
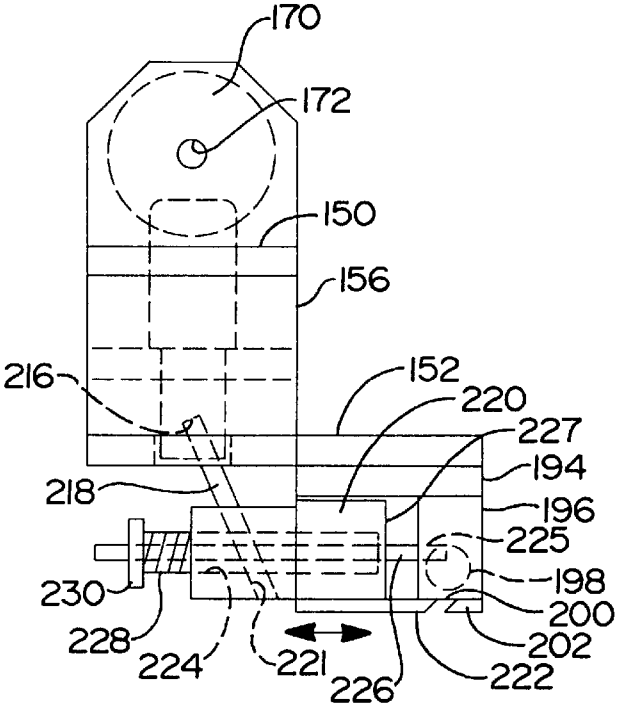
FIG. 8A is a detail side plan view of a movable upper clamp assembly according to a preferred embodiment of the invention, showing internal features of the clamp assembly in phantom, the clamp assembly forming one part of the apparatus of FIG. 2.
Figure 8B:
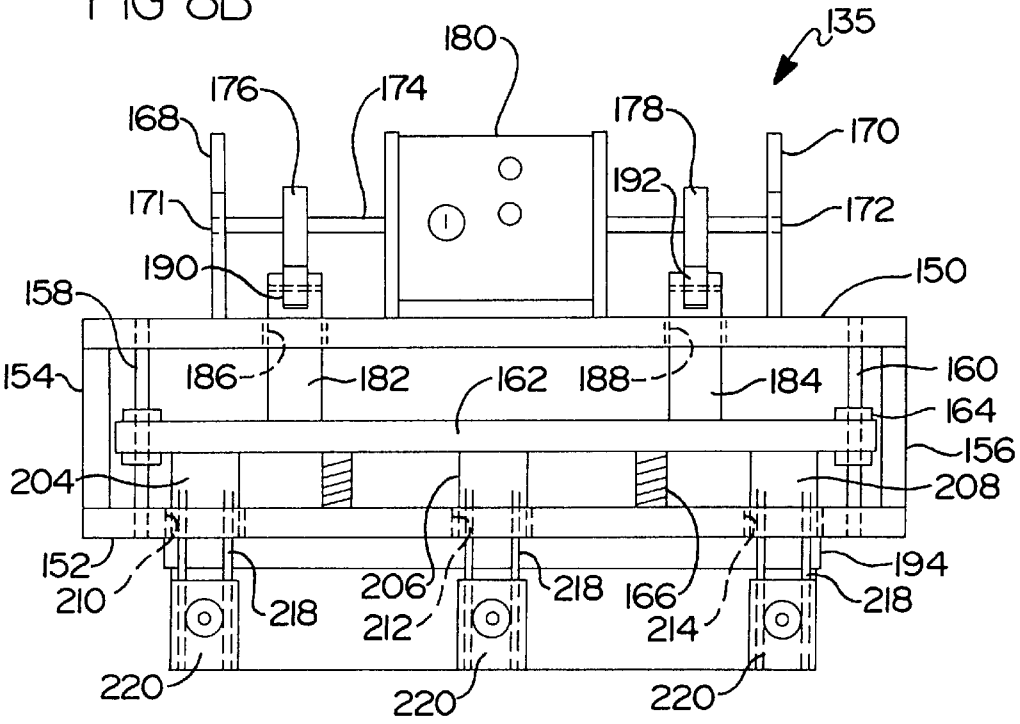
FIG. 8B is an end plan view of the clamp assembly of FIG. 8A.

Referring now to FIGS. 8A and 8B, a preferred clamp assembly 135 is shown for use as either or, preferably, as both of the upper and lower clamps 134, 136. To be used as the lower clamp 134, a mirror image of the clamp assembly 135 would be rotated about a horizontal line until it was upside down, that is, 180 degrees opposite to that shown in FIG. 8A. Operations of these clamps are controlled by the controller 50, which receives continuous input from the registration electric eye 54 as well as from other position sensors, as may be appropriate for a particular application. This preferred clamp design uses a combination of vacuum and mechanical clamping to firmly grasp the bag form for folding and cutting operations.

Each of the upper and lower clamp assemblies are substantially identical in the preferred embodiment of the invention, with the exception that the upper clamp assembly 136 is connected to additional hardware (not shown) to lift it upwardly and move it towards the draw rollers to fold the rectangular shape into the bottom of the bag. Conventional pneumatic or hydraulically actuated machinery may be used for this lifting and moving operation. Because of this similarity between the upper and lower clamp assemblies, only the upper clamp assembly 136 will be described in detail here, with the understanding that the lower clamp assembly 134 contains complimentary structural components, and works in a similar way to grasp a transverse section of the bag.

In the preferred design of the clamp assembly 136, a rectangular upper base plate 150 is fixedly attached to a rectangular, horizontally oriented lower base plate 152 by the use of interconnecting side plates 154, 156. A pair of vertically oriented bearing rods 158, 160 are also fixed in place between the upper and lower base plates 150, 152, as shown. In addition, there are two more bearing rods behind those shown in FIG. 8B for a total of four bearing rods joining the upper and lower base plates together adjacent the corners thereof An intermediate plate or armature plate 162 is slidably mounted on to the bearing rods 158, 160 between the upper and lower base plates using bushings 164 journaled in place in holes (not shown) formed in the four corners of the armature plate where the bearing rods pass through. At least two, and preferably four return springs 166 are located between the armature plate 162 and the lower base plate 152, as shown, and are held in place using conventional methods. A pair of vertically oriented parallel camshaft support plates 168, 170 extend upwardly from, and are rigidly attached to, the top of the upper base plate 150. Each of the camshaft support plates 168,170 has a hole 171, 172, respectively, formed therein, and these holes receive opposite ends of a camshaft 174 therein. The camshaft 174 has a pair of eccentric cams 176, 178 attached thereto. The center section of the camshaft 174 also passes through a rotary actuator 180, which is also mounted to the upper support plate 150 between the camshaft support plates 168, 170. The rotary actuator 180 may include an electric motor, or alternatively, may be pneumatically operated. In any case, the rotary actuator 180 is provided to rotate the camshaft 174, as directed by the controller 50. A pair of vertically oriented cam followers 182, 184 are affixed to the upper surface of the armature plate 162 and pass through bores 186, 188 provided in the upper base plate 150. Preferably, each of the cam followers 182, 184 has a roller bearing 190, 192, respectively, rotatably mounted to the top end thereof The roller bearings 190, 192 at the top of the respective cam followers 182,184, each contact one of the cams 176, 178 as shown. It will be understood from the foregoing description that when the rotary actuator 180 spins the camshaft 174, the cams 176, 178 will intermittently push on the cam followers 182, 184, and cause the armature plate 162 to move up and down in a reciprocating motion. The armature plate also has some additional hardware mounted thereon, which reciprocates along with it, as will be further detailed below.

As seen in the side plan view of FIG. 8A, the lower base plate 152 is about twice as wide as the upper base plate 150, and extends beyond the upper base plate and the side plate 156, to the right as shown in the drawing. The lower base plate 152 has a spacer plate 194 fixedly attached to the underside thereof, with a vacuum block 196 also fixedly attached to the underside of the spacer plate 194 at the leading edge thereof The vacuum block 196 has a hollow chamber 198 formed therein, which is in intermittent communication with a vacuum source (not shown). The lower surface of the vacuum block 196 communicates with the hollow chamber 198 through a series of apertures 200 formed therebetween. A stationary clamp jaw 202 is affixed to the underside of the vacuum block at the leading edge thereof.

A series of three drive bars 204, 206, 208 are attached to, and extend downwardly from, the lower surface of the armature plate 162. The drive bars pass through passages 210, 212, 214 formed respectively through the lower base plate 152. As shown best in FIGS. 8A and 8B viewed concurrently, each drive bar has a pair of angular bores 216 formed therein which receive metal push pins 218 therein. As shown in FIG. 8A, the push pins 218 are oriented at an acute angle to the vertical and slant towards the vacuum block 196 as they extend downwardly from their respective drive bar.

A series of three identical slide blocks 220 are slidably attached to the underside of the spacer plate 194, and are slidably movable in the direction of the arrow in FIG. 8A. Since the slide blocks 220 and their associated hardware are identical, only one slide block, as depicted in FIG. 8A, will be described herein, with the understanding that each of the three slide blocks 220 shown in FIG. 8B works in the same way. Each slide block 220 has a movable clamp jaw 222 rigidly affixed to the lower surface thereof, and the movable clamp jaw 222 extends outwardly beyond the slide block 220, as shown. The slide block 220 also has a pair of angular throughbores 221 formed therethrough which receive the push pins 218 therein. The throughbores 221 are formed larger than the push pins 218, to allow springs 228 to set the clamping tension on the slide blocks, as will be further detailed hereinbelow. Each slide block 220 also has a central horizontal passage 224 formed therethrough which receives a threaded rod 226. The threaded rod 226 fits threadably and engagingly into a threaded passage 225 formed in the vacuum block 196 for that purpose. A coil spring 228 also fits inside each central horizontal passage surrounding each respective threaded rod 226. The coil spring 228 cannot pass all the way through the slide block 220 because of a narrowed diameter portion 227 of the passage 224. The threaded rod 226, however, does pass all the way through the slide block, freely passing through the narrowed diameter portion 225, in such a way that the slide block 220 is slidably movable thereon. The coil spring 228 tends to exert a pushing force on the slide block 220 at the narrowed diameter portion 227, tending to push the slide block along the threaded rod 226 towards the vacuum block 196. An internally threaded spring tension adjuster 230 fits threadably and adjustably on to the end of the threaded rod 226 at the end of the slide block 220 opposite the narrowed diameter portion 227 of the passage 224, and is adjustable to set tension on the spring 228.

In use, when the armature plate moves downwardly, it pushes down on the drive bars 204, 206, 208, causing the push pins 218 to slide downwardly in the angular bores 221 of the slide blocks. Since the push pins are oriented at an angle to the vertical, downward vertical movement of the push pins puts a horizontal force on the slide blocks 220 in a direction away from the vacuum blocks 196, which is to the left in FIG. 8A. This force moves the slide blocks 220 away from the stationary vacuum blocks 196, to open up a space between the clamp jaws 202, 222. Conversely, when the return springs 166 push the armature plate 162 upwardly, the push pins are pulled upwardly in the slide blocks, and they move the slide blocks toward the vacuum blocks 196 to close the clamp jaws 202, 222 together. The final clamping force is applied by the springs 228, as adjusted by the spring tension adjusters 230. This occurs because the angular throughbores 221 in the slide blocks are larger in diameter than the push pins 218, and as the push pins reach their limit of vertical stroke, the springs 228 continue pushing the clamp jaws 202, 222 together.

Operation and timing of the clamping assemblies 134, 136 is controlled by the controller 50 to synchronize the operation of the total apparatus 30.

A movable knife blade 133 is located next to the draw roller assembly 132. The knife blade 133 serrates the bag form 45 at the lower edge of the header section 74, and cuts off each finished bag from the web 120 at the same time that the folding operation is completed. Where an adhesive is used in the pockets of the bag, it is cured at this stage, preferably by exposure to ultraviolet light. Suitable equipment is used to remove finished bags as they come out of the apparatus 30.

Referring again to FIG. 4, a finished bag 56 may be seen as a foldable plastic bag having a flat rectangular bottom 53, a front 55, a back 57, and two sides 59, 61 interconnecting the front to the back and having gussets formed therein. The bottom 53 is attached to the front, back, and sides, and a central portion 58 of each of the front, back, and sides has a multiplicity of perforations formed therethrough to allow for ventilation of the bag. The shape and geometry of the bag, and the fold lines thereon, are made the same as a conventional brown paper bag in order to be as familiar as possible to the consuming public.

Figure 5C:
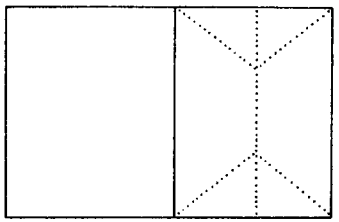
FIG. 5C is a top plan view of a series of bags which are attached together in an end-to-end configuration.
Figure 5D:
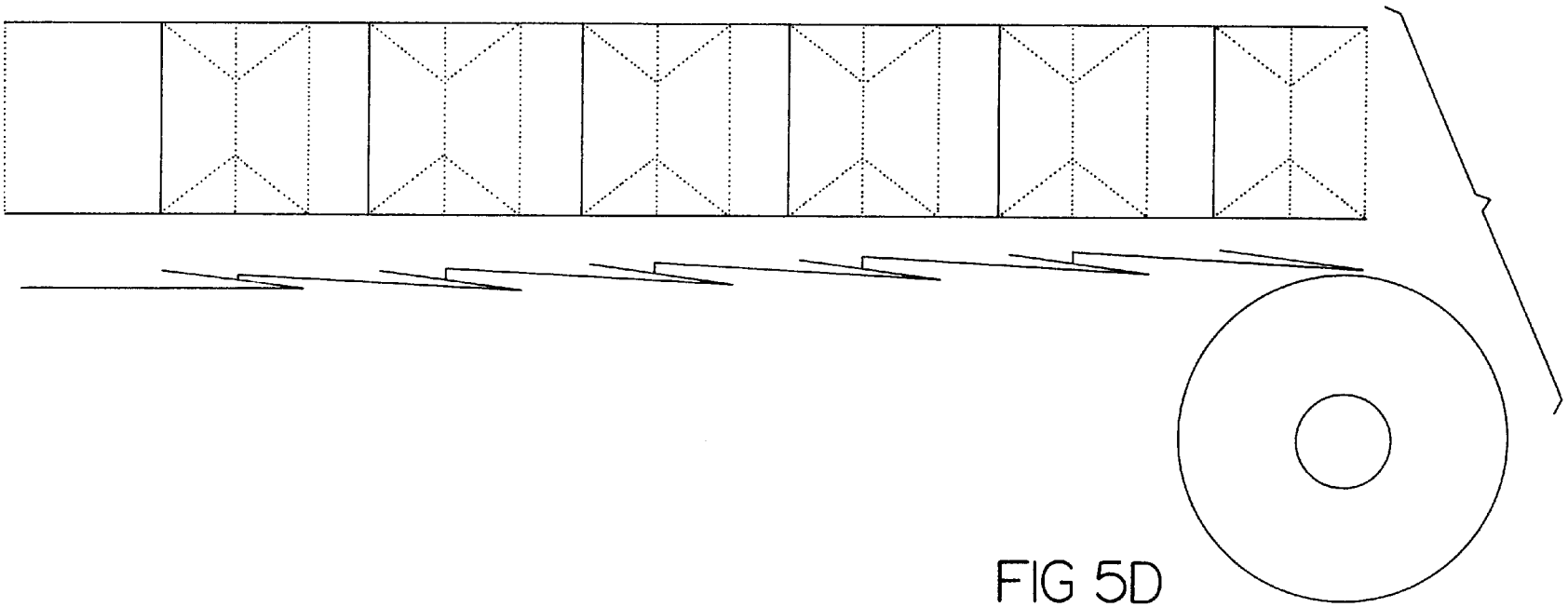
FIG. 5D is a side plan view of the bag series of FIG. 5C, also showing the bags being wound on to a roll.

A sequence of folded bags can be assembled into a group of bags in one of a number of different ways, as preferred by a user of the machine. Folded bags may be connected together end to end and made into a roll of bags, as shown in FIGS. 5C and 5D. Alternatively, folded bags may be piled up to form a stack 76 as shown in FIG. 5A, and the header 75 of a stack 76 is then fused together into a unit by the application of heat thereto. Such a unit of stacked bags can be mounted on, and used in conjunction with, a bag stand 140 of the type illustrated in FIG. 7, which shows a 5-step sequence in using the stand 140.

Figures 7A, 7B, 7C, 7D, 7E, 7F:
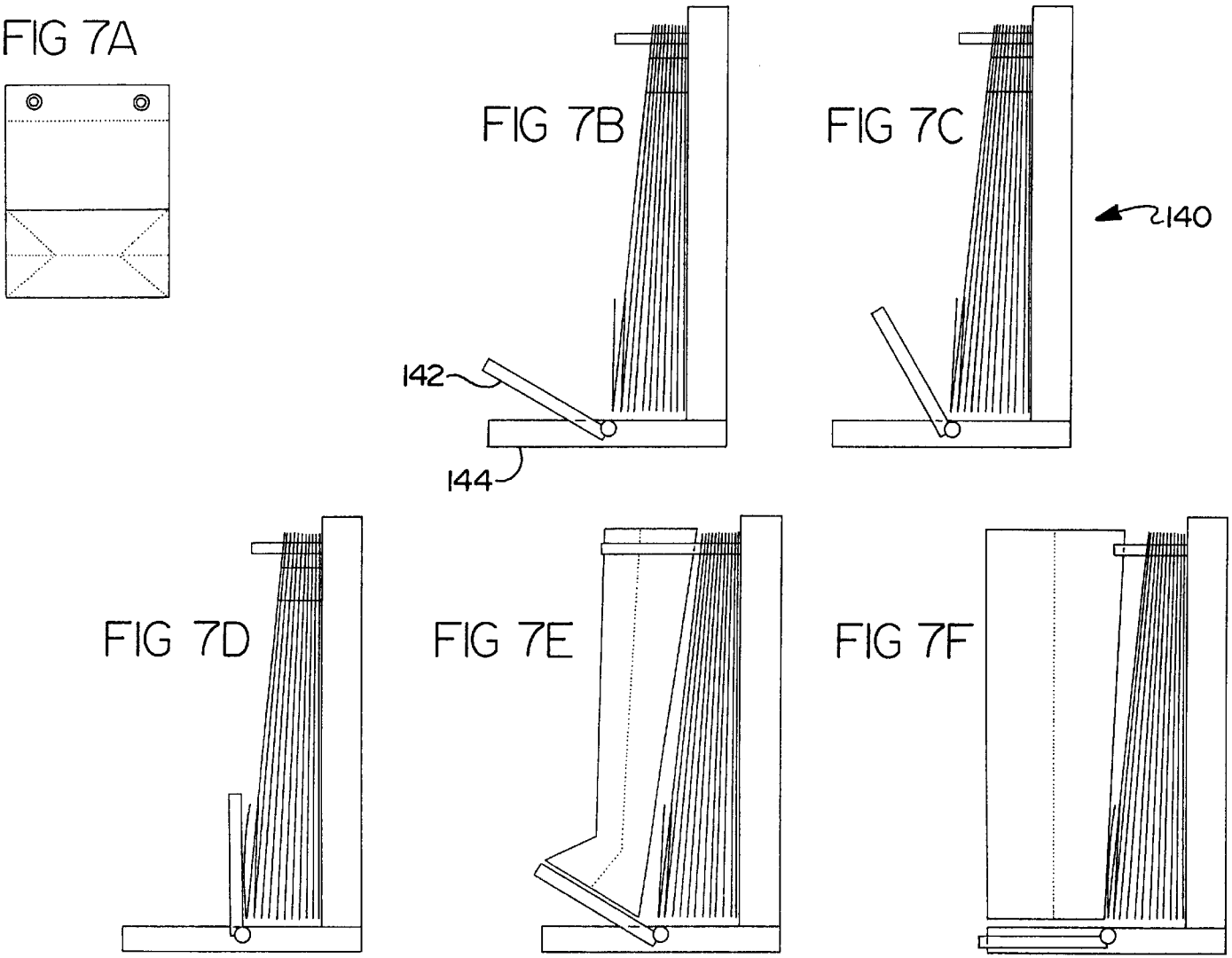
FIG. 7 illustrates a sequential series of side plan views which illustrate steps in using a bag support device with a stack of bags which are products of the method and apparatus of the present invention.

The bag stand 140 as shown in FIG. 7 is an automatic dispenser of bags. As a preferred embodiment, the sequence depicted in steps 1 through 5 is triggered by removing pressure from the subplate 142. In the case of the very first bag in a stack of bags, the pressure will be provided by the operator simply pressing and releasing the subplate 142. Subsequent bags in the stack would be triggered by lifting the loaded bag from the base plate 144, thus starting sequence 1 to 5.

Although the present invention has been described herein with respect to a preferred embodiment thereof, the foregoing description is intended to be illustrative, and not restrictive. Those skilled in the art will realize that many modifications of the preferred embodiment could be made and would be operable. All such modifications which are within the scope of the claims are intended to be within the scope and spirit of the present invention.

Having, thus, described the invention, what is claimed is:

1. An apparatus for forming flat-bottomed plastic bags from a roll of plastic film tubing comprising:

means for feeding ungusseted plastic tubing define a bag form having an upper surface and a lower surface and two side edges;

separating means for separating the upper and lower surfaces of the bag form;

gusseting means for moving the side edges of the bag form inwardly to form gussets between the upper and lower surfaces;

sealing means for sealing the bag form at a lower end thereof;

cutting means for cutting the bag form away from the roll to define a bag wherein said cutting means is disposed intermediate the sealing means and creasing means, and said creasing means being operable to form a pocket in a bag adjacent to the bottom thereof; and creasing means for creasing the bag to form a flat bottom thereon.

2. The apparatus of claim 1, wherein the separating means comprises a gusset plate assembly for placement inside the tubing, the gusset plate assembly comprising an upper gusset plate, a lower gusset plate, and a reinforcement member which interconnects the upper and lower gusset plates, the gusset plates extending beyond the reinforcement member on two sides thereof.

3. The apparatus of claim 2, wherein each of the upper and lower gusset plates have trailing edges with rollers attached thereto for facilitating the movement of plastic film tubing therepast.

4. The apparatus of claim 2, wherein the gusseting means comprises a pair of guide members disposed on opposite sides of the gusset plate assembly for guiding opposite side edges inwardly, each guide member having a bag contacting section which is disposed between the upper and lower gusset plates.

5. The apparatus of claim 4, wherein each guide member comprises a support shaft and a rotatable disc pivotally mounted on the shaft, a portion of the disc being disposed between the upper and lower gusset plates.

6. The apparatus of claim 1, and further comprising means for inserting an adhesive in the pocket.

7. The apparatus of claim 1, further comprising means for perforating the bag form to allow for ventilation of a bag which is a final product thereof.

8. The apparatus of claim 7, wherein the bag perforation means comprises a first plate having a line of electrodes embedded therein, a second plate which is connected to ground, and a controller, the electrodes being energizable to burn a line of perforations through the bag form when activated by the controller.

9. The apparatus of claim 7, wherein the bag perforation means is operable to perforate only a central portion of a bag form.

10. An apparatus for forming flat-bottomed plastic bags from a roll of plastic film tubing comprising:

means for measuring a predetermined length of the tubing to define a bag form having an upper surface and a lower surface and two side edges;

gusseting means for moving the side edges of the bag form inwardly to form gussets between the upper and lower surfaces;

separating means for separating the upper and lower surfaces of the bag form, said separating means comprising a gusset plate assembly for placement inside the tubing, the gusset plate assembly comprising an upper gusset plate, a lower gusset plate, and a reinforcement member which interconnects the upper and lower gusset plates, the gusset plates extending beyond the reinforcement member on two sides thereof, each of the upper and lower gusset plates having trailing edges with rollers attached thereto for facilitating the movement of plastic film tubing therepast;

means for sealing the bag form at a lower end thereof;

means for cutting the bag form away from the roll to define a bag; and means for creasing the bag to form a flat bottom thereon.

11. An apparatus for forming flat-bottomed plastic bags from a roll of plastic film tubing, comprising:

means for measuring a predetermined length of the tubing to define a bag form having an upper surface and a lower surface and two side edges;

separating means for separating the upper and lower surfaces of the bag form, said separating means comprising a gusset plate assembly for placement inside the tubing, said gusset plate assembly comprising an upper gusset plate, a lower gusset plate, and a reinforcement member which interconnects the upper and lower gusset plates, the gusset plates extending beyond the reinforcement member on two sides thereof;

gusseting means for moving the side edges of the bag form inwardly to form gussets between the upper and lower surfaces, said gusseting means comprising a pair of guide members disposed on opposite sides of the gusset plate assembly for guiding opposite side edges inwardly, each guide member having a bag contacting section which is disposed between the upper and lower gusset plates, each guide member comprising a support shaft and a rotatable disc pivotally mounted on the shaft, a portion of the disc being disposed between the upper and lower gusset plates;

means for sealing the bag form at a lower end thereof;

means for cutting the bag form away from the roll to define a bag; and means for creasing the bag to form a flat bottom thereon.

12. An apparatus for forming flat-bottomed plastic bags from a roll of plastic film tubing comprising:

means for feeding ungusseted plastic tubing define a bag form having an upper surface and a lower surface and two side edges;

separating means for separating the upper and lower surfaces of the bag form;

gusseting means for moving the side edges of the bag form inwardly to form gussets between the upper and lower surfaces and comprising a pair of opposed rollers for forming the gussets;

sealing means for sealing the bag form at a lower end thereof;

cutting means for cutting the bag form away from the roll to define a bag; and creasing means for creasing the bag to form a flat bottom thereon.

* * * * *